United States Patent [19]

Takigawa

[11] 4,069,689

[45] Jan. 24, 1978

[54] RACKING MECHANISM FOR DOUBLE-CYLINDER REVOLVING CAM-BOX CIRCULAR KNITTING MACHINE

[75] Inventor: Kazue Takigawa, Shimizumachi, Japan

[73] Assignee: Daitoseiki Company Limited, Japan

[21] Appl. No.: 713,094

[22] Filed: Aug. 10, 1976

Related U.S. Application Data

[63] Continuation of Ser. No. 505,034, Sept. 11, 1974, abandoned.

[30] Foreign Application Priority Data

Sept. 18, 1973 Japan ..... 48-109639

[51] Int. Cl.[2] ..... D04B 9/10

[52] U.S. Cl. ..... 66/14; 66/56

[58] Field of Search ..... 66/14, 26, 56, 95

[56] References Cited

U.S. PATENT DOCUMENTS

| | | | |
|---|---|---|---|
| 1,891,956 | 12/1932 | Sirmay | 66/26 |
| 2,286,805 | 6/1942 | Hurd et al. | 66/14 X |

FOREIGN PATENT DOCUMENTS

| | | | |
|---|---|---|---|
| 275,614 | 8/1928 | United Kingdom | 66/95 |
| 1,008,588 | 10/1965 | United Kingdom | 66/14 |

*Primary Examiner*—Mervin Stein
*Assistant Examiner*—A. M. Falik
*Attorney, Agent, or Firm*—Whittemore, Hulbert & Belknap

[57] ABSTRACT

A double-cylinder revolving cam-box circular knitting machine including pawl and ratchet structure which is selectively operable to perform a racking motion wherein one of the coupled cylinders of the knitting machine mounted at top and bottom is revolved in the circumferential direction concentrically with respect to the other.

2 Claims, 3 Drawing Figures

RACKING MECHANISM FOR DOUBLE-CYLINDER REVOLVING CAM-BOX CIRCULAR KNITTING MACHINE

This application is a continuation of application Ser. No. 505,034 filed Sept. 11, 1974, abandoned.

DESCRIPTION OF THE PRIOR ART

In the past, circular knitting machines have often been of the revolving cylinder type. Wherein a revolving cam-box type circular knitting machine has been provided in the past, they have either provided no means or particularly complicated, expensive and inefficient means for revolving the cylinders with respect to each other.

SUMMARY OF THE INVENTION

The present invention relates to a double-cylinder revolving cam-box circular knitting machine wherein one of the top and bottom cylinders is mounted rotatably in the circumferential direction, and concentrically with respect to the other, and means are provided to provide a controlled step-by-step rotation of one cylinder with respect to the other so as to make it possible to obtain a racked stitch such as the cable stitch and the like.

BRIEF DESCRIPTION OF THE DRAWINGS

Referring to the drawings, an embodiment of the present invention is described hereinafter.

I – VII in FIG. 1 are construction drawings showing the steps taken to knit a cable stitch by means of the device in the present invention.

DETAILED DESCRIPTION OF THE INVENTION

Figure 1:
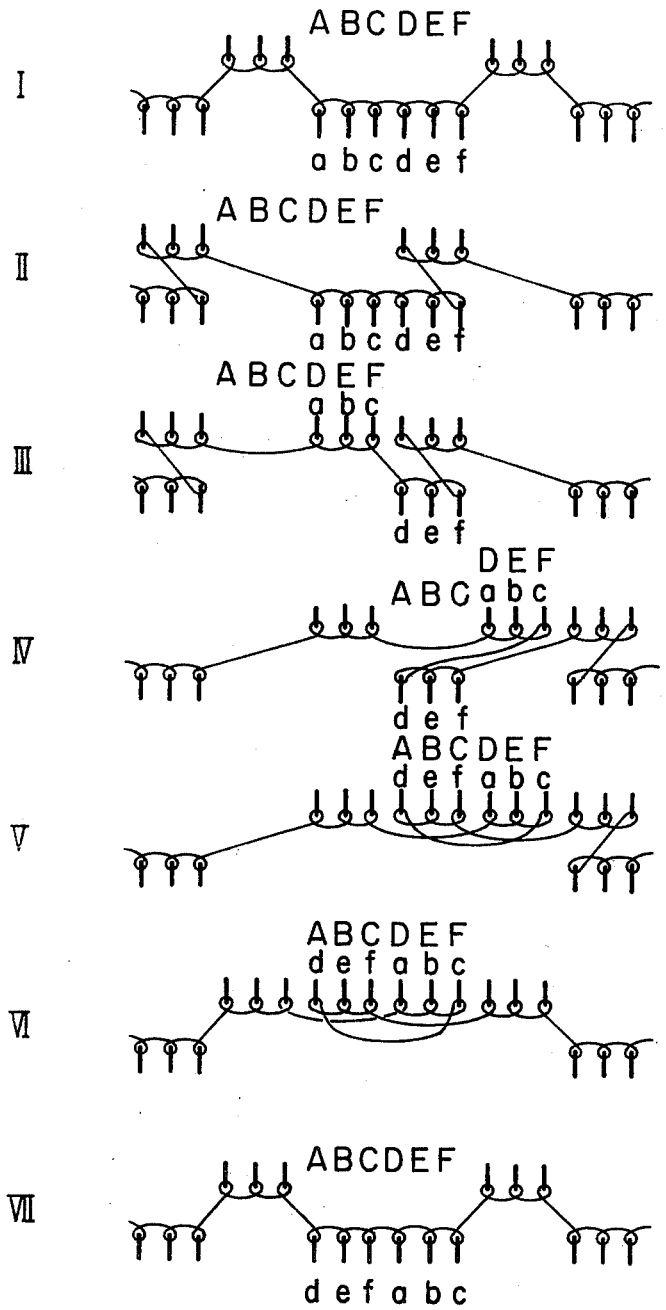

A top cylinder 3 has a diameter equal to a bottom cylinder, and is positioned face-to-face with, and above, the bottom cylinder 2 which is mounted on a bottom frame 1. The top cylinder 3 is retained by a cylinder holder 6 and a cylinder mounting disc 7 on the top table that is supported by pillars 4 planted on the bottom frame 1. A moving plate 8, a top cam mounting cylinder 9 and a large top spur gear 10 are rotatably mounted on a top table 5. The large top spur gear 10 engages with a small spur gear 12 secured to the upper end of a drive shaft 11, which is supported by the bottom frame 1 and the top table 5. The small spur gear 13 at the lower end of the drive shaft 11 engages with a large spur gear 14 which is supported by the bottom frame 1.

It is to be noted that the members 6, 7, and 3 are secured together and held in a stationary position by the detent devices. Element 8 however is in continual rotation with the camming plate 9.

During the formation of cable stitches the cam mounting cylinders of the top and bottom cylinders are continually rotated while the bottom cylinder is held stationary and the top cylinder 3 is selectively rotated in steps with respect to the bottom cylinder.

A cam 15 for producing rightward racking and a cam 16 for producing leftward racking are secured to the moving plate 8. And then, a ratchet 17 for rightward racking and a ratchet 18 for leftward racking are fixed to the cylinder holder 6. 19 is a racking device for rotating the cylinder 3 to rightward and it pivotally supports a pawl 22 at one end of a slightly bent lever 21 which is supported on the top table 5 through a shaft 20. The pawl 22 is formed integrally with a latch 24 for the wire 23, said latch 24 being energized to always press the pawl 22 against the ratchet 17 by a spring 25. 26 is a racking device for leftward racking and pivotally supports a pawl 29 at one end of a slightly bent lever 28 that is retained on the top table 5 through a shaft 27. A pawl 29 is formed integrally with a latch 31 for the wire 30, the latch 31 being energized to always press the pawl 29 against the ratchet 18 by a spring 32.

Figure 2:
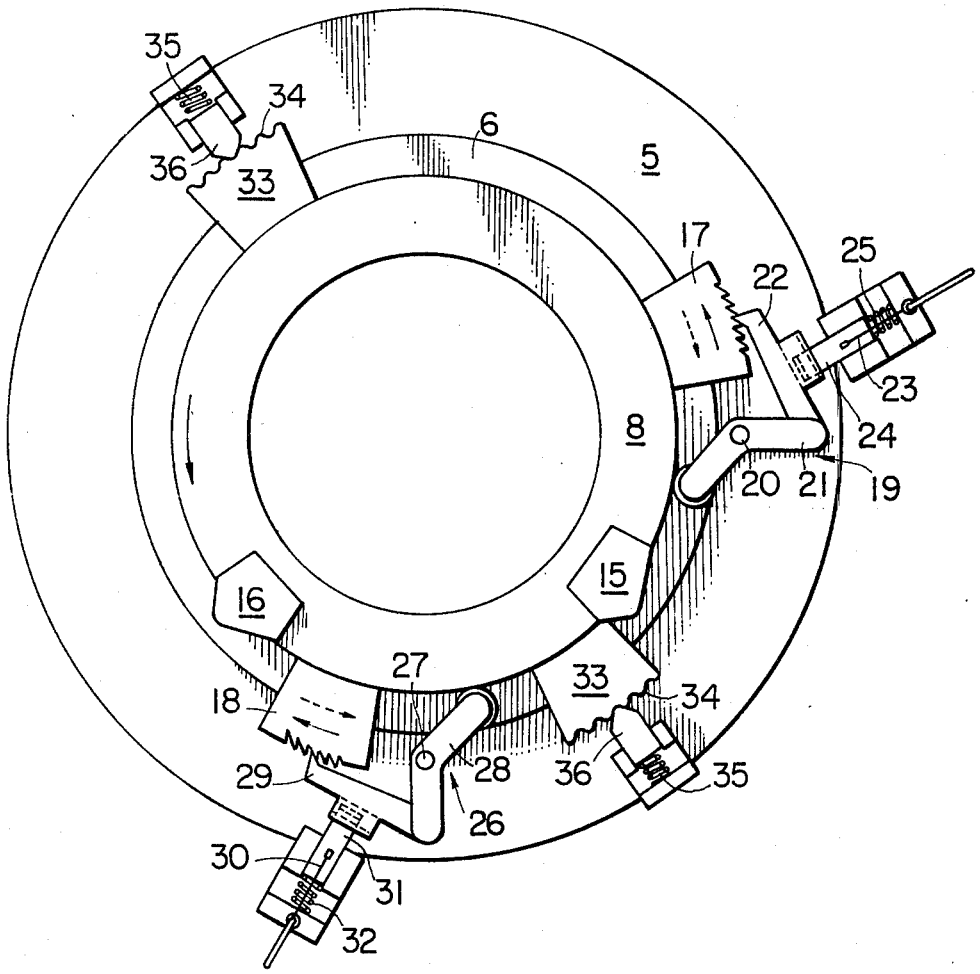
FIG. 2 is a plan view of the device in the present invention.
Figure 3:
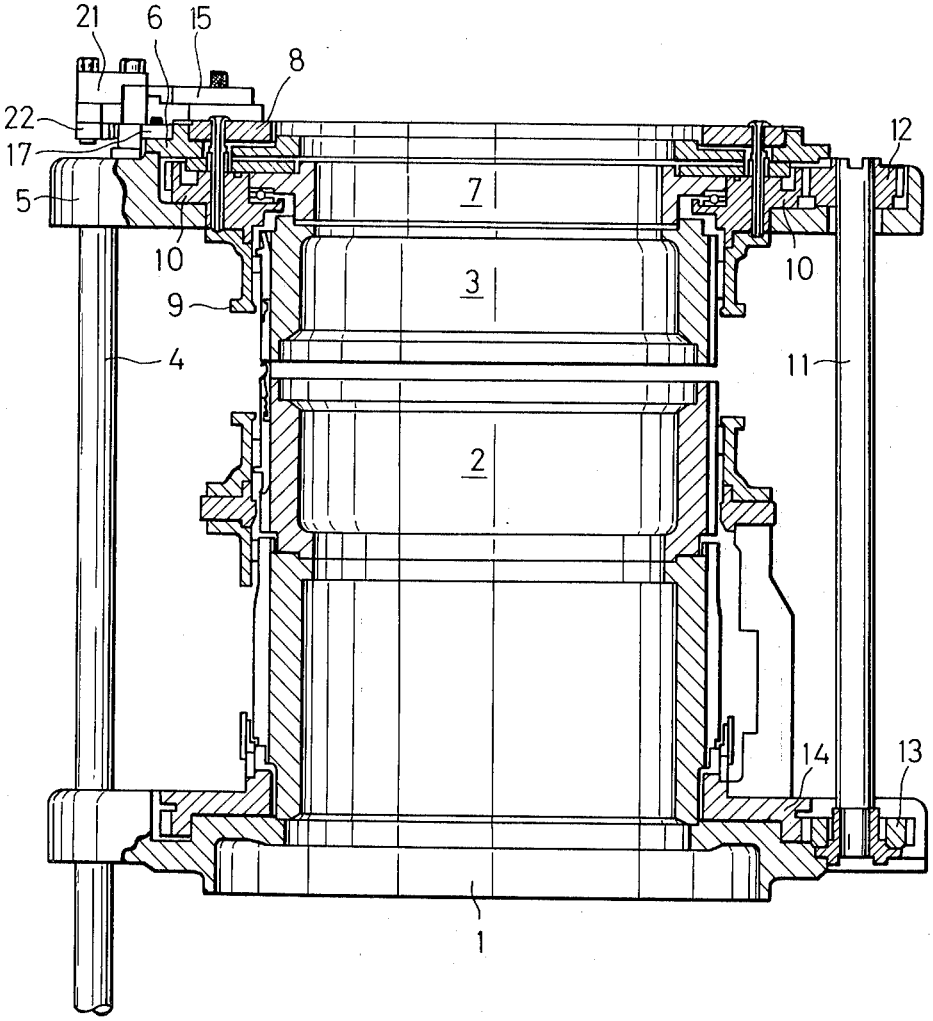
FIG. 3 is a vertical sectional face view of the same.

A stopper 33 is supported by the cylinder holder 6 and its peripheral saw-toothed portion 34 is in threaded engagement with a pawl 36 that is pressed by a spring 35. Two stoppers are provided as shown in FIG. 2.

As a knitting example, steps taken in knitting a cable stitch with the device in the present invention are shown in FIG. 1. In accordance with the same steps shown in FIG. 1, racking in the direction of the cylinder circumference and transfer of needles toward the top and bottom cylinders are performed. Needle transfer is carried out in the manner described hereinafter, while racking is halted the wires 23 and 30 are pulled outward by electromagnets (not shown in the drawing) and consequently the pawls 22 and 29 are not engaged with the ratchets 17 and 18. With the rotation of the moving plate 8, the cams 15 and 16 revolve simultaneously, touch the end of the slightly bent levers 21 and 28 respectively, and turn the lever 21 counterclockwise and then the lever 28 is turned toward clockwise. However, the ratchets 17 and 18 are at a standstill due to the detachment of the pawls 22 and 29 from the ratchets 17 and 18.

When the top cylinder 3 is required to rotate leftward (i.e., clockwise) in three pitches of the ratchet teeth, the pawl 29 should be geared with the ratchet 18 for leftward racking by suspending the function of the electromagnet (not shown in the drawings) that pulls the wire 30 according to instruction from a patterning plate (not shown in the drawing) and pressing the wire latch 31 against the pawl 29 by the use of the repulsion force of the spring 32. Then, the pawl 29 moves the ratchet 18 leftward in a length of three pitches of the ratchet teeth at a time, when the cam 16 for leftward racking, moving together with the rotation of moving plate 8, comes into contact with the end portion of the slightly bent lever 28 and turns the same lever 28 clockwise. The ratchet 18 for leftward racking is disposed so as to move integrally with the top cylinder 3 through the cylinder holder 6, so that the top cylinder 3 is turned leftward in a length of three pitches of ratchet teeth with the movement of the ratchet 18. Upon completion of the foregoing motion, the above-mentioned electromagnet acts again, pulling the wire 30, and disengages the pawl 29 from the leftward ratchet 18, and as a result, racking motion is not performed even when the cam 16 for producing leftward racking comes into contact again with the end portion of the slightly bent lever. When racking motion is required in six pitches of the ratchet teeth in succession, the suspension of the function of the driving electromagnet, which gives two revolutions to the moving plate 8, is sufficient for the requirement.

In case that the top cylinder 3 is required to rotate rightward, the rightward racking device 19 is actuated in a manner similar to that of the leftward racking device 26.

As described herein, in this invention the racking motion on the top cylinder is performable with the action of the racking device accompanying the revolution of the moving plate, which means that a racking motion higherto possible only on the weft knitting machine becomes possible on the circular knitting machine as well.

What is claimed is:

1. A double-cylinder revolving cam-box circular knitting machine including two cylinders of substantially equal diameter each having an axis of generation positioned adjacent each other with their axis of generation congruent, which cylinders are mounted for at least limited rotation relative to each other about their axis of generation, racking device means operably connected between the cylinders for rotating the cylinders in either direction about their axis of generation with respect to each other, an annular plate mounted adjacent one of the cylinders having an axis of generation which is congruent with the axis of generation of the circular cylinders, means for continually rotating the annular plate about its axis of generation, and cam means secured to the annular plate operably associated with the racking device for controlled actuating of the racking device.

2. A double-cylinder revolving cam-box circular knitting machine as set forth in claim 1, wherein the racking device comprises a slightly bent lever pivotally supported in a fixed position adjacent the one end of the one cylinder, a pawl pivotally supported by the slightly bent lever, a ratchet operably associated with the one cylinder for controlled rotary movement therewith, and wire latch means for selectively engaging the pawl with the ratchet.

* * * * *